US009701006B2

(12) United States Patent
Borst

(10) Patent No.: US 9,701,006 B2
(45) Date of Patent: Jul. 11, 2017

(54) POWER TOOLS WITH RECONFIGURABLE SECONDARY SWITCH

(71) Applicant: Ingersoll-Rand Company, Davidson, NC (US)

(72) Inventor: Laurence V. Borst, Long Valley, NJ (US)

(73) Assignee: Ingersoll-Rand Company, Davidson, NC (US)

( * ) Notice: Subject to any disclaimer, the term of this patent is extended or adjusted under 35 U.S.C. 154(b) by 583 days.

(21) Appl. No.: 14/184,943

(22) Filed: Feb. 20, 2014

(65) Prior Publication Data

US 2015/0231778 A1 Aug. 20, 2015

(51) Int. Cl.
*B25F 5/02* (2006.01)
*B25F 5/00* (2006.01)

(52) U.S. Cl.
CPC . *B25F 5/02* (2013.01); *B25F 5/00* (2013.01)

(58) Field of Classification Search
None
See application file for complete search history.

(56) References Cited

U.S. PATENT DOCUMENTS 4,493,377 A 1/1985 Gunther et al.
5,150,523 A 9/1992 McCurry
5,724,737 A 3/1998 Stones
5,793,141 A * 8/1998 Simonsen ..... B24B 23/02 310/238
5,969,312 A 10/1999 Svetlik et al.
6,548,776 B1 4/2003 Jong
(Continued)

FOREIGN PATENT DOCUMENTS

CN 201439197 4/2010
CN 101885178 11/2010
(Continued)

OTHER PUBLICATIONS

Sealey & Son Timbers, "Einhell Cordless Hedge Trimmer—Power Tools," available at http://sealeyandsontimbers.com.au/store/power-tools/einhell-cordless-hedge-trimmer.html (last visited May 21, 2013).

(Continued)

*Primary Examiner* — Michelle Lopez
*Assistant Examiner* — Chinyere Rushing-Tucker
(74) *Attorney, Agent, or Firm* — Barnes & Thornburg LLP

(57) ABSTRACT

In one illustrative embodiment, a power tool may comprise a housing supporting a motor, a primary switch coupled to the housing and configured to control a supply of energy to the motor, and an secondary switch that is reconfigurable between a first position near the primary switch and a second position spaced apart from the first position. When the secondary switch is coupled to the housing in the first position, the primary switch and the secondary switch may be configured such that a user holding the power tool with only one hand can operate both the primary switch and the secondary switch using the one hand. When the secondary switch is coupled to the housing in the second position, the primary switch and the secondary switch may be configured to require the user of the power tool to simultaneously operate the primary switch and the secondary switch using two hands.

20 Claims, 8 Drawing Sheets

(56) References Cited

U.S. PATENT DOCUMENTS

| | | | | |
|---|---|---|---|---|
| 7,178,248 | B2 | 2/2007 | Richards | |
| 7,210,542 | B2 | 5/2007 | Lam et al. | |
| 7,407,015 | B2 | 8/2008 | Stones | |
| 8,230,942 | B2 | 7/2012 | Steverding et al. | |
| 8,276,280 | B2 | 10/2012 | Lee et al. | |
| 2003/0196824 | A1 | 10/2003 | Gass et al. | |
| 2003/0206779 | A1* | 11/2003 | Kopras | B25F 5/003 409/182 |
| 2004/0035009 | A1* | 2/2004 | Richards | A01G 3/053 30/381 |
| 2004/0194982 | A1 | 10/2004 | Fukuzumi et al. | |
| 2005/0126009 | A1* | 6/2005 | Stones | A01G 3/053 30/100 |
| 2006/0102367 | A1* | 5/2006 | Etter | B25B 21/00 173/218 |
| 2006/0220612 | A1* | 10/2006 | Feldmann | B25F 5/022 320/114 |
| 2007/0114049 | A1* | 5/2007 | Steverding | B25B 21/00 173/4 |
| 2008/0135272 | A1 | 6/2008 | Wallgren | |
| 2011/0147026 | A1* | 6/2011 | Pellenc | B26B 15/00 173/170 |
| 2012/0023761 | A1 | 2/2012 | Martinsson et al. | |
| 2013/0186665 | A1 | 7/2013 | Hua | |
| 2014/0014385 | A1* | 1/2014 | Kosugi | B25F 5/02 173/217 |
| 2014/0028226 | A1* | 1/2014 | Mergener | H02P 6/14 318/400.09 |
| 2015/0075832 | A1* | 3/2015 | Cheng | B25F 5/02 173/218 |
| 2016/0256987 | A1* | 9/2016 | Ely | B25B 21/004 |

FOREIGN PATENT DOCUMENTS

| | | | |
|---|---|---|---|
| CN | 103052474 | | 4/2013 |
| CN | 203077178 | | 7/2013 |
| EP | 0 469 757 | A1 | 2/1992 |
| EP | 0 622 015 | A | 1/1997 |
| EP | 0 750 837 | A1 | 1/1997 |
| EP | 2 140 983 | A2 | 1/2010 |
| EP | 1 787 507 | B1 | 7/2011 |
| GB | 1 215 774 | | 12/1970 |
| GB | 2 291 744 | A | 1/1996 |
| WO | WO9411162 | | 5/1994 |
| WO | 0196064 | | 12/2001 |
| WO | 2005/063451 | A1 | 7/2005 |
| WO | 2009092672 | | 7/2009 |
| WO | 2011/119153 | A1 | 9/2011 |
| WO | 2012/167241 | A1 | 12/2012 |
| WO | WO2012167241 | | 12/2012 |

OTHER PUBLICATIONS

Chinese Application No. 201510086863.X; Power Tools With Reconfigurable Secondary Switch; First Office Action Dated Dec. 5, 2016.

* cited by examiner

POWER TOOLS WITH RECONFIGURABLE SECONDARY SWITCH

TECHNICAL FIELD

The present disclosure relates, generally, to power tools, and, more particularly, power tools having a reconfigurable secondary switch.

BACKGROUND

In addition to a primary switch that controls the supply of energy to a motor, many power tools have an secondary switch that controls a direction of operation of the motor (e.g., forward or reverse operation). This secondary switch is often accessible by a user of the power tool with the same hand used to activate the primary switch, allowing one-handed operation of the power tool. If one-handed operation of a power tool is deemed potentially hazardous to a user, an additional switch is typically added to the tool to require two-handed operation. Such power tools often require the user to depress both the primary switch and the additional switch, which is placed in a position on the power tool such that the same hand of the user cannot depress both the primary switch and the additional switch at the same time. This configuration ensures that both of the user's hands are away from the output of the power tool, reducing the potential for injury.

SUMMARY

According to one aspect, a power tool may comprise a housing supporting a motor, a primary switch coupled to the housing, and an secondary switch. The primary switch may be configured to control a supply of energy to the motor. The secondary switch may be reconfigurable between a first position near the primary switch and a second position spaced apart from the first position. When the secondary switch is coupled to the housing in the first position, the primary switch and the secondary switch may be configured such that a user holding the power tool with only one hand can operate both the primary switch and the secondary switch using the one hand. When the secondary switch is coupled to the housing in the second position, the primary switch and the secondary switch may be configured to require the user of the power tool to simultaneously operate the primary switch and the secondary switch using two hands.

In some embodiments, when the secondary switch is coupled to the housing in the first position, the secondary switch may be configured to control a direction of operation of the motor. In some embodiments, when the secondary switch is coupled to the housing in the second position, the secondary switch may be configured to control the supply of energy to the motor in conjunction with the primary switch, such that both the primary switch and the secondary switch must be simultaneously operated for energy to be supplied to the motor. In such embodiments, the secondary switch may further be configured to control the direction of the operation of the motor when the secondary switch is coupled to the housing in the second position. In other embodiments, the primary switch may be further configured to control the direction of operation of the motor when the secondary switch is coupled to the housing in the second position.

In some embodiments, when coupled to the housing in the second position, the secondary switch may be mounted partially within the housing such that an activation surface of the secondary switch is exposed to an exterior of the housing. In some embodiments, when coupled to the housing in the first position, the secondary switch may be mounted entirely within the housing. Further, the power tool may comprise a first shuttle extending through a first aperture formed in the housing. The first shuttle may include a first cam surface configured to activate the secondary switch when the secondary switch is coupled to the housing in the first position and the first shuttle slides through the first aperture. In some embodiments, the first shuttle may be configured to be locked to prevent movement of the first shuttle relative to the housing when the secondary switch is coupled to the housing in the second position.

In some embodiments, the power tool may further comprise a second shuttle extending through a second aperture formed in the housing. The first and second apertures may be formed in opposing sides of the housing. The second shuttle may include a second cam surface configured to activate the secondary switch when the secondary switch is coupled to the housing in the first position and the second shuttle slides through the second aperture. In some embodiments, the first and second shuttles may each include an interlocking feature allowing the first and second shuttles to be locked together to prevent movement of the first and second shuttles relative to the housing when the secondary switch is coupled to the housing in the second position. In some embodiments, the first shuttle may be flush with the first aperture and the second shuttle may be flush with the second aperture, when the first and second shuttles are locked together.

According to another aspect, a power tool may comprise a housing supporting a motor, a primary switch coupled to the housing, and an secondary switch that may be reconfigurable between a first position near the primary switch and a second position spaced apart from the first position. When the secondary switch is coupled to the housing in the first position, the secondary switch may be configured to perform a first function. When the secondary switch is coupled to the housing in the second position, the secondary switch may be configured to perform a second function.

In some embodiments, the first function may comprise controlling a direction of operation of the motor. In some embodiments, the second function may comprise controlling the supply of energy to the motor in conjunction with the primary switch, such that both the primary switch and the secondary switch must be simultaneously operated for energy to be supplied to the motor.

In some embodiments, when coupled to the housing in the second position, the secondary switch may be further configured to perform the first function in addition to the second function. In some embodiments, the primary switch may be configured to perform the first function in addition to controlling the supply of energy to the motor.

In some embodiments, the power tool may further comprise an electronic controller positioned in the housing. The primary switch may be communicatively coupled to a first input of the electronic controller. The secondary switch may be communicatively coupled to a second input of the electronic controller, both when the secondary switch is coupled to the housing in the first position and when the secondary switch is coupled to the housing in the second position. When the secondary switch is coupled to the housing in the first position, the electronic controller may be configured to execute a first set of instructions that implement the first function. When the secondary switch is coupled to the housing in the second position, the electronic controller may be configured to execute a second set of instructions that implement the second function.

According to yet another aspect, a method of reconfiguring a power tool comprising a housing, a primary switch, and an secondary switch may comprise removing the secondary switch from a first position in which the secondary switch is coupled to the housing near the primary switch such that the primary and secondary switches allow one-handed operation of the power tool and installing the secondary switch in a second position in which the secondary switch is coupled to the housing away from the primary switch such that the primary and secondary switches require two-handed operation of the power tool.

In some embodiments, the method of reconfiguring the power tool may further comprise reconfiguring an electronic controller of the power tool such that the secondary switch, when coupled to the housing in the second position, performs a different function than when the secondary switch was coupled to the housing in the first position.

BRIEF DESCRIPTION OF THE DRAWINGS

The concepts described in the present disclosure are illustrated by way of example and not by way of limitation in the accompanying figures. For simplicity and clarity of illustration, elements illustrated in the figures are not necessarily drawn to scale. For example, the dimensions of some elements may be exaggerated relative to other elements for clarity. Further, where considered appropriate, reference labels have been repeated among the figures to indicate corresponding or analogous elements. The detailed description particularly refers to the accompanying figures in which.

DETAILED DESCRIPTION OF THE DRAWINGS

Figure 1:
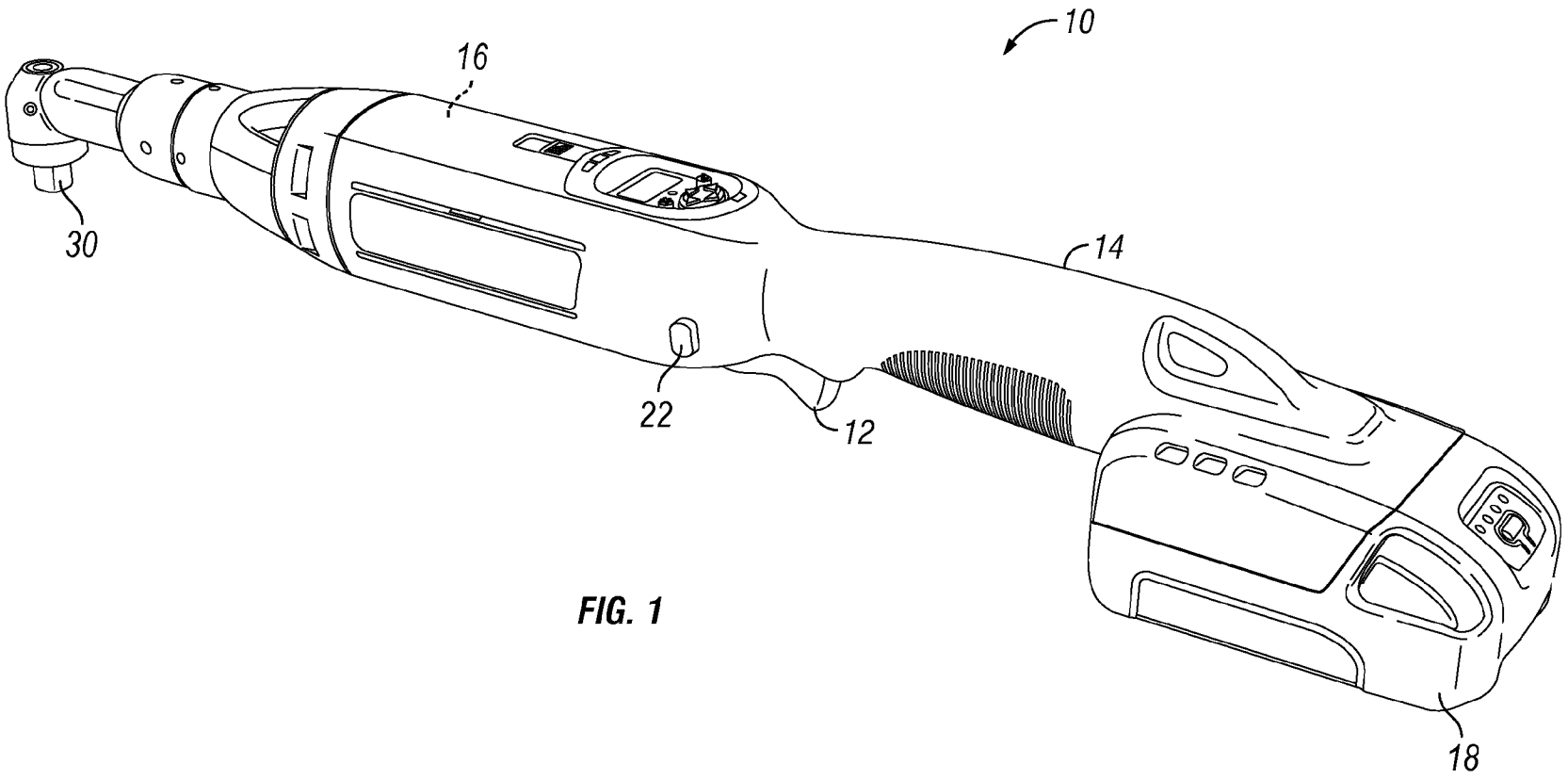
FIG. 1 is a perspective view of one illustrative embodiment of a power tool having a primary switch and a reconfigurable secondary switch.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the present disclosure.

Referring now to FIG. 1, one illustrative embodiment of a power tool 10 having a primary switch 12 and a reconfigurable secondary switch 20 is shown. The primary switch 12 is coupled to a housing 14 of the power tool 10 and is configured to control a supply of energy to a motor 16 supported in the housing 14. In the illustrative embodiment shown in FIG. 1, the primary switch 12 is embodied as a trigger 12 positioned near a handle portion of the housing 14 (the handle portion being adapted to be gripped by a user when operating the power tool 10). It will be appreciated that, in other embodiments, the primary switch 12 may be embodied as any other suitable type of user input device and/or may be positioned in any other suitable location on the housing 14.

When a user activates the primary switch 12 (e.g., depresses the trigger 12), the primary switch 12 connects the motor 16 to an energy source 18 coupled to the power tool 10 to supply energy to the motor 16. The supply of energy to the motor 16 will cause rotation of a rotor of the motor 16, thereby driving an output 30 of the power tool 10 (for instance, via a drive train included in the power tool 10). For instance, in the illustrative embodiment shown in FIG. 1, the motor 16 being supplied with energy will result in rotation of an output shaft 30 of the power tool 10. The energy source 18 may be illustratively embodied as a rechargeable battery 18 coupled to the power tool 10 (as shown in FIG. 1), an electrical cord (e.g., electrically coupled to AC mains power), or a hose or other conduit for pressurized air (e.g., fluidly coupled to an air compressor). Although the power tool 10 is illustratively shown as a right angle wrench in FIG. 1, it is contemplated that the concepts of the present disclosure may be incorporated into any type of power tool.

Figure 2:
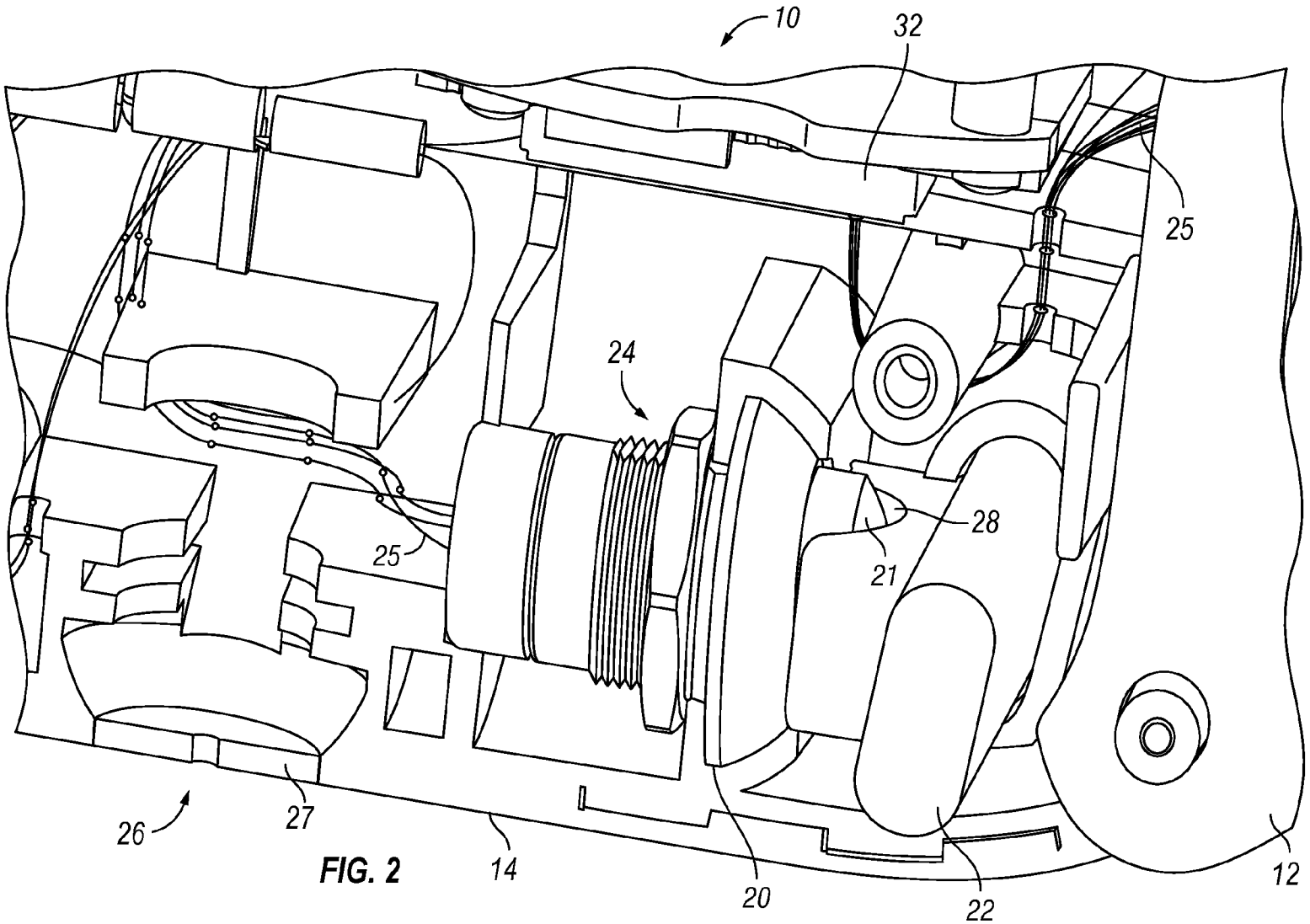
FIG. 2 is a partial cross-sectional view of a central portion of the power tool of FIG. 1, showing the secondary switch positioned near the primary switch.
Figure 3:
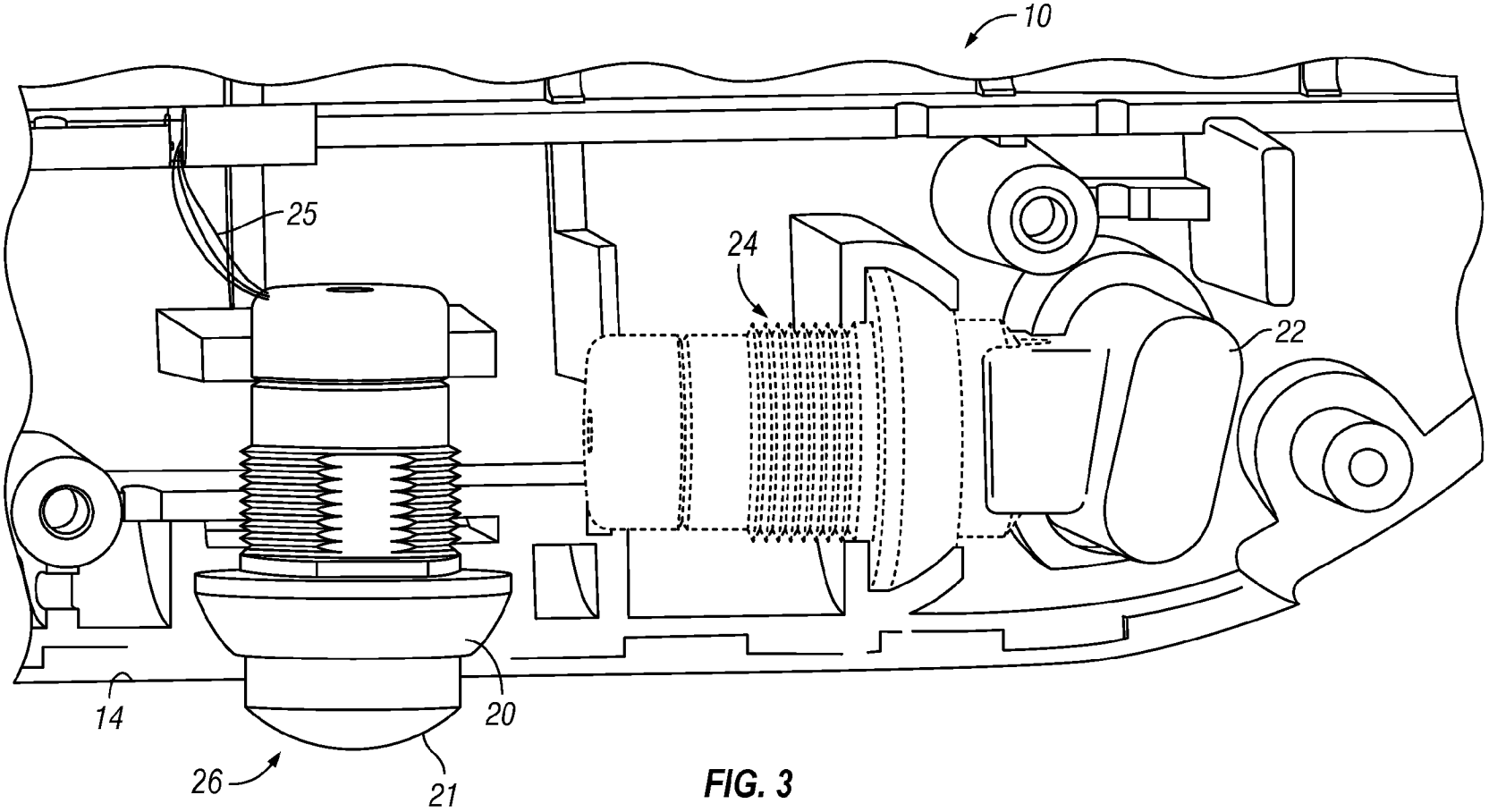
FIG. 3 is a partial cross-sectional view of a central portion of the power tool of FIG. 1, showing the secondary switch positioned away from the primary switch.

FIGS. 2 and 3 illustrate partial cross-sectional views of a central portion of the power tool 10, showing the reconfigurable secondary switch 20 of the power tool 10. As can been seen in FIGS. 2 and 3, the housing 14 of the power tool 10 includes two mounting positions 24, 26 for the secondary switch 20 (the two mounting positions 24, 26 being spaced apart from one another). In particular, FIG. 2 shows the secondary switch 20 coupled to the housing 14 in the mounting position 24 that is near the primary switch 12, while FIG. 3 shows the secondary switch 20 coupled to the housing 14 in the mounting position 26 that is away from the primary switch 12. In the illustrative embodiment, the secondary switch 20 is mounted entirely within the housing 14 when in the mounting position 24 (no portion of the secondary switch 20 is exposed to the exterior of the housing 14), while the secondary switch 20 is mounted only partially within the housing 14 when in the mounting position 26 (such that an activation surface 21 of the secondary switch 20 is exposed to an exterior of the housing 14). When in the mounting position 26, the activation surface 21 of the secondary switch 20 may protrude through an aperture formed in the housing 14 (which aperture may be partially or wholly sealed by a blanking plate 27 when the secondary switch 20 is instead in the mounting position 24, as shown in FIG. 2).

The secondary switch 20 may be illustratively embodied as any type of user input device. In the illustrative embodiment shown in FIGS. 2 and 3, the secondary switch 20 is embodied as a momentary hall switch 20 that outputs an electrical signal when the activation surface 21 of the secondary switch 20 is physically depressed. The secondary switch 20 is electrically coupled to an electronic controller 32 of the power tool 10 via a number of wires 25 that carry electrical signals representing the state of the secondary switch 20 to the electronic controller 32. Similarly, the primary switch 12 is electrically coupled to the electronic controller 32 of the power tool 10 via a number of wires 25 that carry electrical signals representing the state of the primary switch 12 to the electronic controller 32.

In the illustrative embodiment, the power tool 10 also includes a shuttle 22 disposed near the mounting position 24 of the secondary switch 20. As best seen in FIG. 1, one end of the shuttle 22 extends through an aperture formed in a side wall of the housing 14. Similarly, the opposite end of the shuttle 22 extends through another aperture formed in an opposing side wall of the housing 14 (not shown). The shuttle 22 is configured to slide from side-to-side such that portions of the shuttle 22 pass through these apertures formed in the side walls of the housing 14. The shuttle 22 includes a cam surfaces 28 that engage the activation surface 21 of the secondary switch 20 as the shuttle 22 slides to one side or the other (when the secondary switch 20 is coupled to the housing 14 in the mounting position 24).

Figure 4:
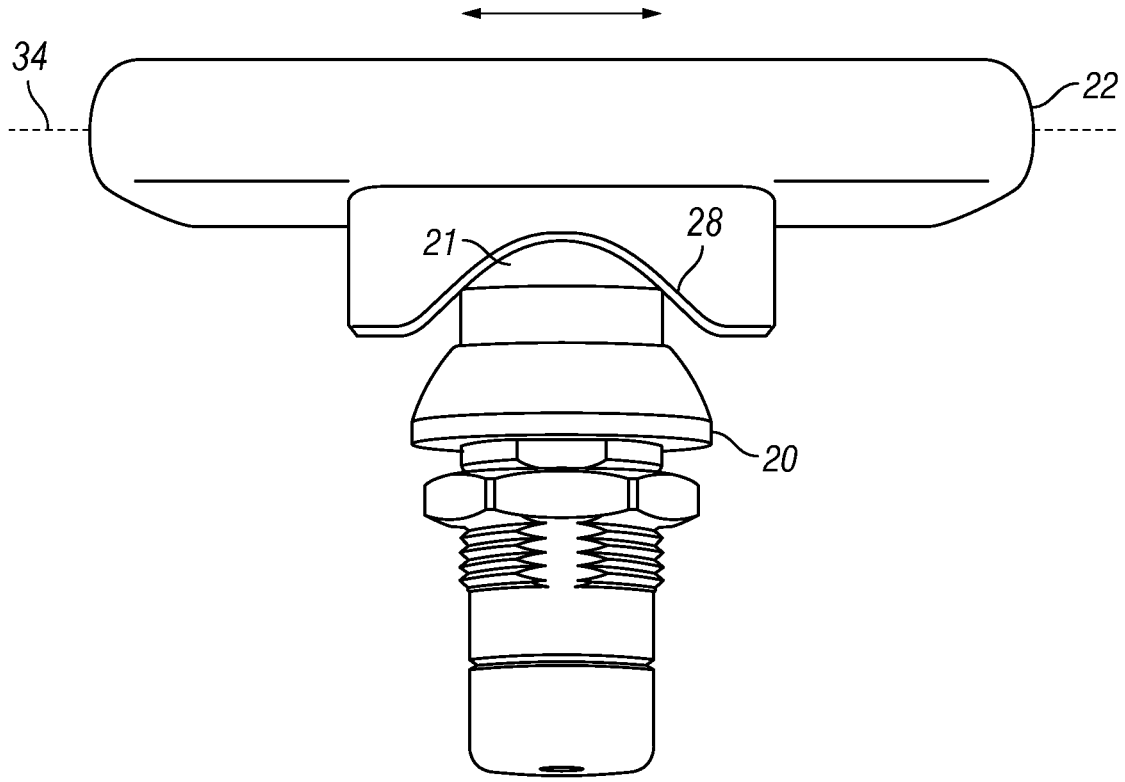
FIG. 4 is an isolated, top view of the secondary switch and a shuttle of the power tool of FIG. 1.

FIG. 4 illustrates an isolated, top view of the shuttle 22 and the secondary switch 20 (in the mounting position 24), showing the side-to-side motion of the shuttle 22 along a shuttle axis 34. As will be appreciated from FIG. 4, as the shuttle 22 slides along the shuttle axis 34 (in either direction), the cam surface 28 of the shuttle 22 will depress the activation surface 21 of the secondary switch 20 in a direction substantially perpendicular to that of the shuttle axis 34. In some embodiments, when the secondary switch 20 is coupled to the housing 14 in the mounting position 26 (as shown in FIG. 3), the shuttle 22 may be locked in place to prevent side-to-side movement of the shuttle 22. For instance, in one illustrative embodiment, the blanking plate 27 (after being removed from the aperture formed in the bottom surface of the housing 14) may be positioned in the mounting position 24 (formerly occupied by the secondary switch 20). The blanking plate 27 may be sized such that, when positioned in the mounting position 24, the blanking plate 27 abuts the cam surface 28 of the shuttle 22 to resist side-to-side movement of the shuttle 22.

Figure 5:
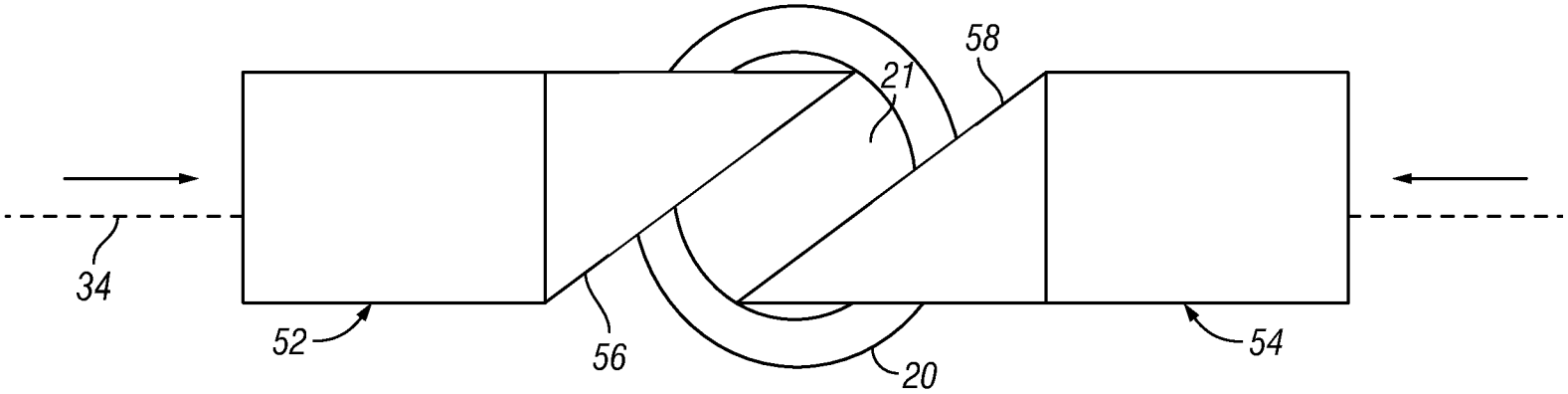
FIG. 5 is a simplified diagram showing one illustrative embodiment of two shuttles that may be used together with the secondary switch of the power tool of FIG. 1.
Figure 6A:
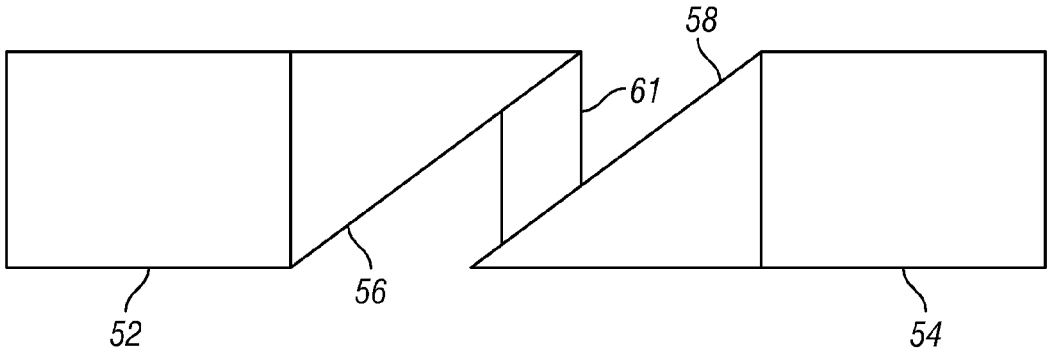
FIG. 6A is a simplified diagram of the two shuttles of FIG. 5 being locked to prevent movement relative to the housing.
Figure 6B:
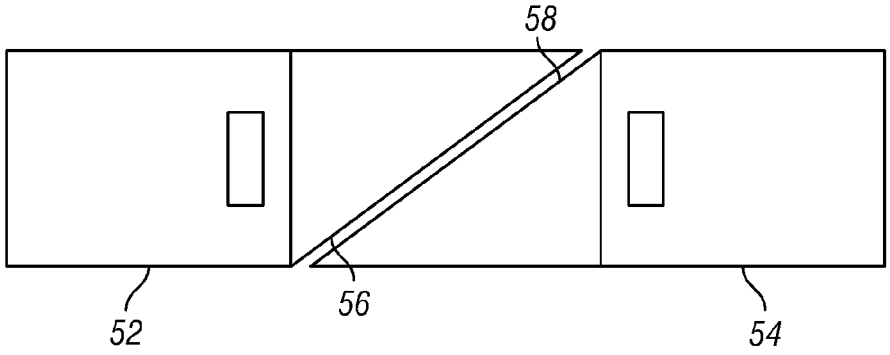
FIG. 6B is another simplified diagram of the two shuttles of FIG. 5 being locked to prevent movement relative to the housing.

In some embodiments, the power tool 10 may include a pair of complementary shuttles 52, 54, as shown in FIGS. 5-6B (rather than the unitary shuttle 22 of FIGS. 1-4). The shuttle 52 may extend through an aperture formed in one side wall of the housing 14, while the shuttle 54 may extend through another aperture formed in an opposing side wall of the housing 14. The shuttles 52, 54 may each slide (independently) from side-to-side such that portions of the shuttles 52, 54 pass through these respective apertures formed in the side walls of the housing 14. The shuttle 52 includes a cam surface 56 that engages the activation surface 21 of the secondary switch 20 as the shuttle 52 slide toward the secondary switch 20 (when the secondary switch 20 is coupled to the housing 14 in the mounting position 24). Similarly, the shuttle 54 includes a cam surface 58 that engages the activation surface 21 of the secondary switch 20 as the shuttle 52 slide toward the secondary switch 20 (when the secondary switch 20 is coupled to the housing 14 in the mounting position 24). As will be appreciated from FIG. 5, as either of the shuttles 52, 54 slides along the shuttle axis 34 (toward the secondary switch 20), the corresponding cam surface 56, 58 will depress the activation surface 21 of the secondary switch 20. Furthermore, the cam surfaces 56, 58 may be shaped complementary to one another, such that movement of the shuttle 52 toward the secondary switch 20 does not cause the shuttle 54 to extend further out of the housing 14, and vice versa.

In some embodiments, when the secondary switch 20 is coupled to the housing 14 in the mounting position 26 (as shown in FIG. 3), the shuttles 52, 54 may be locked in place to prevent side-to-side movement of the shuttles 52, 54. Two illustrative examples of such locking of the shuttles 52, 54 are shown in FIGS. 6A and 6B. In the illustrative embodiment of FIG. 6A, a locking tab 61 may be placed between the two shuttles 52, 54 (after the secondary switch 20 has been removed from the mounting position 24). The locking tab 61 may be sized such that, when positioned between the shuttles 52, 54, the locking tab 61 abuts the cam surfaces 56, 58 to resist side-to-side movement of the shuttles 52, 54. In the illustrative embodiment of FIG. 6B, the shuttles 52, 54 each include an interlocking feature such that, when the shuttles 52, 54 are both pressed inwardly from the exterior of the housing 14, the interlocking features of the shuttles 52, 54 are coupled together (thereby preventing movement of either of the shuttles 52, 54 relative to the housing 14). Moreover, in the illustrative embodiment of FIG. 6B, when the shuttles 52, 54 are locked together via their interlocking features, outer surfaces of the shuttles 52, 54 are flush with the exterior surface of the housing 14 (i.e., flush with the apertures in the housing 14 through which the shuttles 52, 54 slide).

When the secondary switch 20 is coupled to the housing 14 in the mounting position 24 (i.e., near the primary switch 12, as shown in FIG. 2), a user holding the power tool 10 can simultaneously operate both the primary switch 12 (directly) and the secondary switch 20 (indirectly, via the shuttle 22 or the shuttles 52, 54) using only one hand. In other words, a user gripping the handle portion of the housing 14 may operate the primary switch 12 and/or the secondary switch 20 (via the shuttle 22 or the shuttles 52, 54) without needing to adjust his or her grip on the power tool 10. In contrast, when the secondary switch 20 is coupled to the housing 14 in the mounting position 26 (i.e., away from the primary switch 12, as shown in FIG. 3), a user holding the power tool 10 will not be able to simultaneously operate both the primary switch 12 and the secondary switch 20 using the same hand. Rather, simultaneous operation of both the primary switch 12 and the secondary switch 20 will require the user to activate the primary switch 12 with one hand (e.g., a hand gripping the handle portion of the housing 14) and to activate the secondary switch 20 with his or her other hand (e.g., by depressing the activation surface 21 of the secondary switch 20 that protrudes through the aperture formed in the bottom of the housing 14, as shown in FIG. 3). As described further below, the secondary switch 20 may be configured to perform differing functions depending on whether the secondary switch 20 is coupled to the housing 14 in the mounting position 24 or in the mounting position 26.

Figure 7:
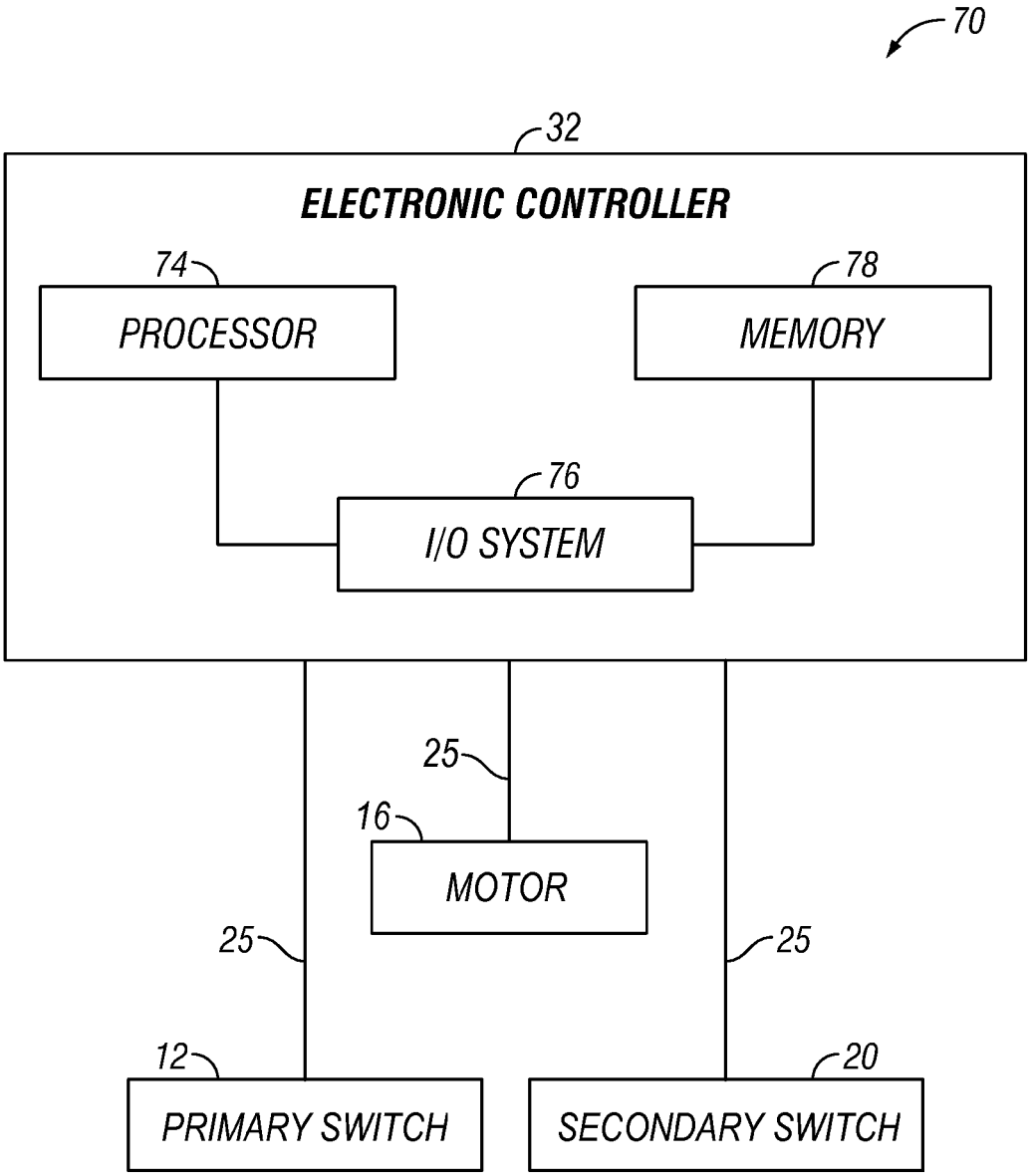
FIG. 7 is a simplified block diagram of an electronic control system of the power tool of FIG. 1.

Referring now to FIG. 7, the power tool 10 illustratively includes an electronic control system 70. The control system 70 generally includes the electronic controller 32, the primary switch 12, the secondary switch 20, and the motor 16. It will be appreciated that, in some embodiments, the control system 70 may include additional or different electronic and/or electromechanical components (which have not been shown in FIG. 7 for clarity), such as additional user input devices, displays or other output devices, sensors for monitoring various operational conditions of the power tool 10, and the like. In the illustrative embodiment, the controller 32 is supported in the housing 14 of the power tool 10 and is communicatively coupled to the primary switch 12, the secondary switch 20, and the motor 16 (as well as other components) via wires 25. In other embodiments, the controller 32 may be communicatively coupled to the primary switch 12, the secondary switch 20, the motor 16 and/or other components of the control system 70 via other types of connections (e.g., other wired connections or wireless links)

The controller 32 is, in essence, a master computer of the power tool 10 responsible for interpreting electrical signals received from various components of the power tool 10 (e.g., the switches 12, 20) and for activating, energizing, or otherwise controlling the operation of electronically-controlled components of the power tool 10 (e.g., the motor 16). To do so, the controller 32 includes a number of electronic components commonly associated with electronic controllers utilized in the control of electromechanical systems. In the illustrative embodiment, the controller 32 of the power tool 10 includes a processor 74, an input/output ("I/O") subsystem 76, and a memory 78. It will be appreciated that the controller 32 may include additional or different components, such as any of those commonly found in a computing device (which are not illustrated in FIG. 7 for clarity). Additionally, in some embodiments, one or more of the illustrative components of the controller 32 may be incorporated in, or otherwise form a portion of, another component of the controller 32 (e.g., as with a microcontroller).

The processor 74 of the controller 32 may be embodied as any type of processor(s) capable of performing the functions described herein. For example, the processor 74 may be embodied as one or more single or multi-core processors, digital signal processors, microcontrollers, or other processors or processing/controlling circuits. Similarly, the memory 78 may be embodied as any type of volatile or non-volatile memory or data storage device capable of performing the functions described herein. The memory 78 stores various data and software used during operation of the controller 32, such as operating systems, applications, programs, libraries, and drivers. For instance, the memory 78 may store instructions in the form of a software routine (or routines) which, when executed by the processor 74, allows the controller 32 to control operation of the power tool 10.

The memory 78 is communicatively coupled to the processor 74 via the I/O subsystem 76, which may be embodied as circuitry and/or components to facilitate I/O operations of the controller 32. For example, the I/O subsystem 76 may be embodied as, or otherwise include, memory controller hubs, I/O control hubs, firmware devices, communication links (e.g., point-to-point links, bus links, wires, cables, light guides, printed circuit board traces, etc.), and/or other components and subsystems to facilitate the I/O operations. In the illustrative embodiment, the I/O subsystem 76 includes an analog-to-digital ("A/D") converter, or the like, that converts analog signals from the switches 12, 20 of the power tool 10 into digital signals for use by the processor 74. It should be appreciated that, if any one or more of the switches 12, 20 associated with the power tool 10 generate a digital output signal, the A/D converter may be bypassed. Similarly, in the illustrative embodiment, the I/O subsystem 76 includes a digital-to-analog ("D/A") converter, or the like, that converts digital signals from the processor 74 into analog signals to control operation of the motor 16 of the power tool 10. It should also be appreciated that, if the motor 16 operates using a digital input signal, the D/A converter may be bypassed.

In the illustrative embodiment, the primary switch 12 is operable to control the supply of energy to the motor 16. As described above, energy being supplied to the motor 16 causes rotation of the rotor of the motor 16 (and, hence, rotation of the output shaft 30 of the power tool 10). The software executed by the controller 32 may cause the controller 32 to interpret electrical signals received from the primary switch 12 (via the I/O subsystem 76) as indicating whether the motor 16 should be supplied with energy (and, in some embodiments, how much energy). As such, the controller 32 may respond to electrical signals received from the primary switch 12 by causing appropriate control signals to be sent (via the I/O subsystem 76) to cause the motor 16 to be supplied with energy.

In some illustrative embodiments, when the secondary switch 20 is coupled to the housing 14 in the mounting position 24 (i.e., near the primary switch 12, as shown in FIG. 2), the secondary switch 20 may be operable to control a direction of operation of the motor 16. In other words, when the secondary switch 20 is in the mounting position 24, the software executed by the controller 32 may cause the controller 32 to interpret electrical signals received from the secondary switch 20 as indicating that a user desires to change the direction of operation of the motor 16 (e.g., from forward to reverse, or vice versa). As such, the software may cause the controller 32 to respond to electrical signals received from the secondary switch 20 (when in the mounting position 24) by sending appropriate control signals to the motor 16 (or to another component) to cause the motor 16 to change its direction of operation. The controller 32 may execute a particular set of software instructions when the secondary switch 20 is coupled to the housing 14 in the mounting position 24 that cause the controller 32 to perform the operations just described.

In some illustrative embodiments, when the secondary switch 20 is coupled to the housing 14 in the mounting position 26 (i.e., away from the primary switch 12, as shown in FIG. 2), the secondary switch 20 may be operable to control the supply of energy to the motor 16 (in conjunction with the primary switch 12). In this manner, a two-handed operation by the user may be enforced when the secondary switch 20 is in the mounting position 26. For instance, the software executed by the controller 32 may cause the controller 32 to send control signals that cause the motor 16 to be supplied with energy only when the controller 32 simultaneously receives electrical signals indicating operation of both the primary switch 12 and the secondary switch 20. In other words, when the secondary switch 20 is in the mounting position 26, the software executed by the controller 32 may require both the primary switch 12 and the secondary switch 20 to be simultaneously operated for energy to be supplied to the motor 16. This change in the functionality of the secondary switch 20 (i.e., performing one function when in the mounting position 24 and another function when in the mounting position 26) may be achieved by reconfiguring the software executed by the controller 32. In other words, the controller 32 may execute another particular set of software instructions when the secondary switch 20 is coupled to the housing 14 in the mounting position 26 (different than the set of software instructions executed by the controller 32 when the secondary switch 20 is coupled to the housing 14 in the mounting position 24) to cause the controller 32 to perform the operations just described.

Furthermore, when the secondary switch 20 is coupled to the housing 14 in the mounting position 26 (i.e., away from the primary switch 12, as shown in FIG. 2), either the primary switch 12 or the secondary switch 20 (or both) may be operable to control a direction of operation of the motor 16. For instance, in some embodiments, the software executed by the controller 32 may be configured to cause the controller 32 to interpret electrical signals received from the primary switch 12 that are indicative of the primary switch 12 being briefly depressed and then released as representing that a user desires to change the direction of operation of the motor 16. Additionally or alternatively, the software executed by the controller 32 may be configured to cause the controller 32 to interpret electrical signals received from the secondary switch 20 that are indicative of the secondary switch 20 being briefly depressed and then released as representing that a user desires to change the direction of operation of the motor 16. In such a control scheme, the software executed by the controller 32 may be configured to cause the controller 32 to interpret simultaneous electrical signals received from either the primary switch 12 and the secondary switch 20 that are indicative of the switches 12, 20 being depressed for longer periods of time as representing that the user desires that energy be supplied to the motor 16. It will be appreciated those of skill in the art that many other control schemes are possible, in addition to the illustrative control schemes described above, by simply reconfiguring the software executed by the controller 32 of the power tool 10.

Figure 8:
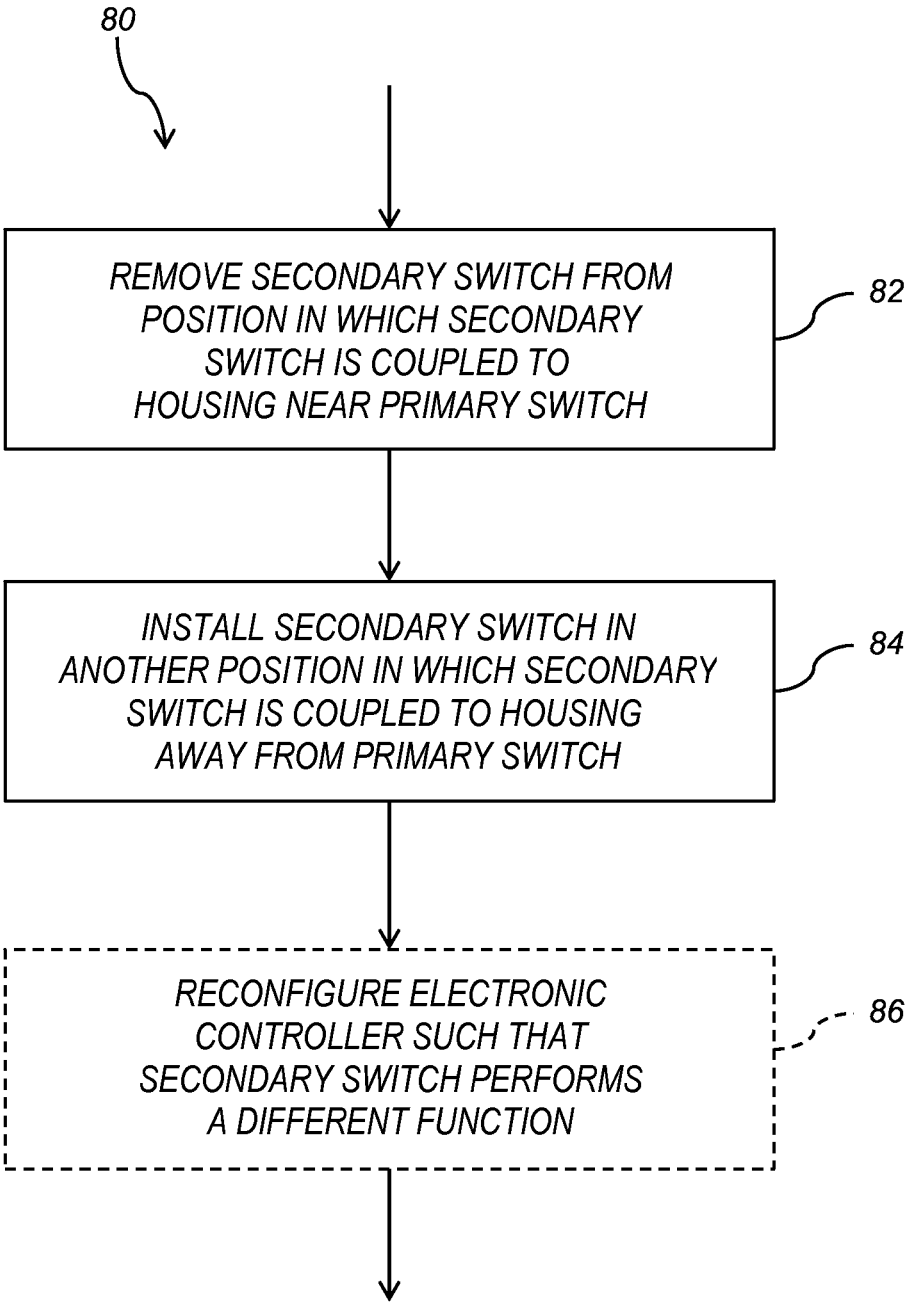
FIG. 8 is a simplified flow diagram of one illustrative embodiment of a method of reconfiguring the power tool of FIG. 1.

Referring now to FIG. 8, one illustrative embodiment of a method 80 of reconfiguring the power tool 10 of FIGS. 1-7 is shown as a simplified flow diagram. The method 80 is illustrated in FIG. 8 as a number of blocks 82-86, which might each be performed by a manufacturer, distributor, and/or end user of the power tool 10, by way of example. The block 86 may be optionally performed in some embodiments of the method 80 (and, thus, is shown in dashed lines in FIG. 8). The method 80 is illustrated in FIG. 8 and described below as involving repositioning of the secondary switch 20 from the mounting position 24 to the mounting position 26 (i.e., to reconfigure the power tool 10 from allowing one-handed operation to requiring two-handed operation). It will be appreciated that another embodiment of the method 80, involving repositioning of the secondary switch 20 from the mounting position 26 to the mounting position 24 (i.e., to reconfigure the power tool 10 from requiring two-handed operation to allowing one-handed operation), might also be performed.

The method 80 begins with block 82 in which the secondary switch 20 is removed from the mounting position 24, in which the secondary switch 20 is coupled to the housing 14 near the primary switch 12 (e.g., as shown in FIG. 2). In some embodiments, block 82 may involve opening the housing 14 to allow the secondary switch 20 to be removed from the mounting position 24. Furthermore, in some embodiments, block 82 may involve locking the shuttle 22 (or, alternatively, the shuttles 52, 54) in place relative to the housing 14 after removing the secondary switch 20 from the mounting position 24. Locking of the shuttle 22 (or the shuttles 52, 54) relative to the housing 14 might be accomplished using any of the illustrative mechanisms described above. (It is also contemplated that, in some embodiments, locking of the shuttle 22 may be performed during or after block 84.)

After block 82, the method 80 proceeds to block 84, where the secondary switch 20 is installed in the mounting position 26, in which the secondary switch 20 is coupled to the housing 14 away from the primary switch 12 (e.g., as shown in FIG. 3). In some embodiments, block 82 may involve removing the blanking plate 27 from the housing 14 to open an aperture in the bottom surface of the housing 14, thereby allowing the activation surface 21 of the secondary switch 20 to be exposed to an exterior of the housing 14. Where the housing 14 was opened in block 82, block 84 may also involve reassembling or closing the housing 14.

In some embodiments, the method 80 may also involve block 86, in which the software executed by the controller 32 is reconfigured to modify the function(s) performed by the secondary switch 20. For instance, different sets of software instructions might be executed by the controller 32 (e.g., depending on whether the secondary switch 20 was in mounting position 24 or in the mounting position 26) to cause the controller 32 to perform different actions in response to electrical signals received from the secondary switch 20. As described above, the software executed by the controller 32 may cause the controller 32 to interpret electrical signals received from the secondary switch 20 as indicating that the direction of operation of the motor 16 should be changed when the secondary switch 20 is in the mounting position 24. In such cases, block 86 may involve reconfiguring the software of the controller 32 such that the controller 32 interprets electrical signals received from the secondary switch 20 as indicating that energy should be supplied to the motor 16 (when received in conjunction with electrical signals from the primary switch 12).

It will be appreciated from the above discussion that, in the illustrative embodiment, the secondary switch 20 is able to remain connected to the same input of the controller 32. In other words, changing the function performed by the secondary switch 20 (in response to the secondary switch 20 moving between the mounting positions 24, 26) does not require re-wiring of the secondary switch 20 to a different input of the controller 32. Rather, modifying the function(s) performed by the secondary switch 20 may simply involve reconfiguring the software executed by the controller 32. As such, the controls of the power tool 10 may be easily reconfigured by a manufacturer, distributor, and/or end user of the power tool 10.

While certain illustrative embodiments have been described in detail in the figures and the foregoing description, such an illustration and description is to be considered as exemplary and not restrictive in character, it being understood that only illustrative embodiments have been shown and described and that all changes and modifications that come within the spirit of the disclosure are desired to be protected. There are a plurality of advantages of the present disclosure arising from the various features of the apparatus, systems, and methods described herein. It will be noted that alternative embodiments of the apparatus, systems, and methods of the present disclosure may not include all of the features described yet still benefit from at least some of the advantages of such features. Those of ordinary skill in the art may readily devise their own implementations of the apparatus, systems, and methods that incorporate one or more of the features of the present disclosure.

The invention claimed is:

1. A power tool comprising:

a housing supporting a motor;

a primary switch coupled to the housing and configured to control a supply of energy to the motor; and an secondary switch that is reconfigurable between a first position near the primary switch and a second position spaced apart from the first position, wherein (i) when the secondary switch is coupled to the housing in the first position, the primary switch and the secondary switch are configured such that a user holding the power tool with only one hand can operate both the primary switch and the secondary switch using the one hand and (ii) when the secondary switch is coupled to the housing in the second position, the primary switch and the secondary switch are configured to require the user of the power tool to simultaneously operate the primary switch and the secondary switch using two hands.

2. The power tool of claim 1, wherein the secondary switch, when coupled to the housing in the first position, is configured to control a direction of operation of the motor.

3. The power tool of claim 2, wherein the secondary switch, when coupled to the housing in the second position, is configured to control the supply of energy to the motor in conjunction with the primary switch, such that both the primary switch and the secondary switch must be simultaneously operated for energy to be supplied to the motor.

4. The power tool of claim 3, wherein the secondary switch, when coupled to the housing in the second position, is further configured to control the direction of operation of the motor.

5. The power tool of claim 3, wherein the primary switch is further configured to control the direction of operation of the motor when the secondary switch is coupled to the housing in the second position.

6. The power tool of claim 1, wherein the secondary switch, when coupled to the housing in the second position, is mounted partially within the housing such that an activation surface of the secondary switch is exposed to an exterior of the housing.

7. The power tool of claim 6, wherein:

the secondary switch, when coupled to the housing in the first position, is mounted entirely within the housing; and the power tool further comprises a first shuttle extending through a first aperture formed in the housing, the first shuttle including a first cam surface configured to activate the secondary switch when the secondary switch is coupled to the housing in the first position and the first shuttle slides through the first aperture.

8. The power tool of claim 7, wherein the first shuttle is configured to be locked to prevent movement of the first shuttle relative to the housing when the secondary switch is coupled to the housing in the second position.

9. The power tool of claim 8, further comprising a second shuttle extending through a second aperture formed in the housing, the first and second apertures being formed in opposing sides of the housing, the second shuttle including a second cam surface configured to activate the secondary switch when the secondary switch is coupled to the housing in the first position and the second shuttle slides through the second aperture.

10. The power tool of claim 9, wherein the first and second shuttles each include an interlocking feature allowing the first and second shuttles to be locked together to prevent movement of the first and second shuttles relative to the housing when the secondary switch is coupled to the housing in the second position.

11. The power tool of claim 10, wherein the first shuttle is flush with the first aperture and the second shuttle is flush with the second aperture when the first and second shuttles are locked together.

12. A power tool comprising:

a housing supporting a motor;

a primary switch coupled to the housing and configured to control a supply of energy to the motor; and an secondary switch that is reconfigurable between a first position near the primary switch and a second position spaced apart from the first position, wherein (i) when the secondary switch is coupled to the housing in the first position, the secondary switch is configured to perform a first function and (ii) when the secondary switch is coupled to the housing in the second position, the secondary switch is configured to perform a second function different from the first function.

13. The power tool of claim 12, wherein the first function comprises controlling a direction of operation of the motor.

14. The power tool of claim 13, wherein the second function comprises controlling the supply of energy to the motor in conjunction with the primary switch, such that both the primary switch and the secondary switch must be simultaneously operated for energy to be supplied to the motor.

15. The power tool of claim 14, wherein the secondary switch, when coupled to the housing in the second position, is further configured to perform the first function in addition to the second function.

16. The power tool of claim 14, wherein the primary switch, when the secondary switch is coupled to the housing in the second position, is further configured to perform the first function in addition to controlling the supply of energy to the motor.

17. The power tool of claim 12, further comprising an electronic controller positioned in the housing, wherein (i) the primary switch is communicatively coupled to a first input of the electronic controller and (ii) the secondary switch is communicatively coupled to a second input of the electronic controller, both when the secondary switch is coupled to the housing in the first position and when the secondary switch is coupled to the housing in the second position.

18. The power tool of claim 17, wherein the electronic controller is configured to execute a first set of instructions that implement the first function, when the secondary switch is coupled to the housing in the first position, and to execute a second set of instructions that implement the second function, when the secondary switch is coupled to the housing in the second position.

19. A method of reconfiguring a power tool comprising a housing, a primary switch, and an secondary switch, the method comprising:

removing the secondary switch from a first position in which the secondary switch is coupled to the housing near the primary switch such that the primary and secondary switches allow one-handed operation of the power tool; and installing the secondary switch in a second position in which the secondary switch is coupled to the housing away from primary switch such that the primary and secondary switches require two-handed operation of the power tool.

20. The method of claim 19, further comprising reconfiguring an electronic controller of the power tool such that the secondary switch, when coupled to the housing in the second position, performs a different function than when the secondary switch was coupled to the housing in the first position.

* * * * *